United States Patent [19]

Newsom

[11] Patent Number: 4,903,453

[45] Date of Patent: Feb. 27, 1990

[54] CONSTRUCTION BLOCKS

[76] Inventor: Bob G. Newsom, HG 83, Box 507, Etty, Ky. 41572

[21] Appl. No.: 246,261

[22] Filed: Sep. 20, 1988

[51] Int. Cl.[4] ..... E04H 12/00

[52] U.S. Cl. ..... 52/648; 52/379; 52/578

[58] Field of Search ..... 52/79.1, 505, 562, 578, 52/698, 582, 588, 652, 378, 379, 414, 415

[56] References Cited

U.S. PATENT DOCUMENTS

| | | | |
|---|---|---|---|
| 1,733,169 | 10/1929 | Purdy | 52/648 |
| 1,889,547 | 11/1932 | Green | 52/415 |
| 2,049,907 | 8/1936 | Hess . | |
| 2,157,688 | 5/1939 | Cascio | 52/378 |
| 2,933,166 | 4/1960 | Castaine | 52/582 |
| 3,720,022 | 3/1973 | Dattner | 52/79 |
| 3,744,194 | 7/1973 | Ramberg | 52/378 |
| 4,227,357 | 10/1980 | Newsom | 52/334 |
| 4,516,375 | 5/1985 | Pagano et al. | 52/650 |
| 4,782,637 | 11/1988 | Eriksson et al. | 52/648 |
| 4,825,620 | 5/1989 | Johnson | 52/648 X |

FOREIGN PATENT DOCUMENTS

| | | | |
|---|---|---|---|
| 530372 | 8/1955 | Italy | 52/79.1 |

*Primary Examiner*—David A. Scherbel
*Assistant Examiner*—Creighton Smith
*Attorney, Agent, or Firm*—Harold Gell

[57] ABSTRACT

A construction method for fabricating structures and a system of building blocks utilized in the method is presented. The blocks are hollow and may be skeletal and formed from heavy gauge strips or molded. They include at least two sub-assemblies joined by interconnecting webs with provisions for single subassemblies to square off wall edges. Each skeletal subassembly includes upper and lower frames joined together by a plurality of structural columns perpendicular to the planes of the upper and lower frames. The upper and lower frames are dimensioned to form interfitting male and female receptacles that permit the blocks to be interconnected. D-lance snap fit structures are provided in the upper and lower frames so that an assembly of blocks with structural integrity may be created by snapping together courses of blocks with each course staggered relative to the adjacent course.

38 Claims, 9 Drawing Sheets

CONSTRUCTION BLOCKS

THE INVENTION

This invention relates to a method for building a structure which is comprised of assembling a plurality of interlocking skeletal building blocks and the building block system incorporated in the method.

BACKGROUND OF THE INVENTION

Historically, man has created structures from masonry blocks. This form of building traces its ancestry from the earliest structures which were piles of rock to contemporary cut stone systems and from sun baked brick to the contemporary trend of utilizing kiln fired bricks and cast cement blocks.

Structures utilizing masonry techniques has become increasingly costly due to the labor and energy involved in transporting the materials to the place of construction and erecting the structure. Masonry items such as brick, cut stone or concrete block are extremely heavy and a significant amount of energy is expended transporting them from their place of origin to the building site. Furthermore, skilled masons are required to lay up the building blocks, whether they be brick, stone or cement and mortar is required to secure the blocks together. Thus the cost of a masonry structure is a function of considerable energy expended in transporting the materials and a significant amount of skilled labor in handling the mortar and blocks.

A second contemporary means of constructions consists of fabricating a structure from a framework of sawn boards and covering the framework with siding and plaster board type materials. This latter method of construction is not as sturdy as the block construction and like the block system, does not provide adequate thermal insulation. Furthermore, the wooden structure is prone to fire and insect damage and it requires constant maintenance to prevent deterioration.

The obvious shortcomings of the foregoing building methods led to the improved construction method disclosed in U.S. Pat. No. 4,227,357 on "Construction Blocks" issued to Bobby G. Newsom on Oct. 14, 1980. In this system, skeletal blocks formed from heavy gauge rod or bar stock are provided with straight and hook projections that permit the blocks to be interconnected to form a structure which will receive furring strips or stringers. This concept provides a significant advancement to construction methods but fails to provide adequate strength for certain load bearing wall applications. Furthermore, the rods or bars forming the building blocks do not provide a means whereby wall board or other covering materials may be fastened to the structure. In the construction blocks of U.S. Pat. No. 4,227,357, furring strips are necessary to provide a surface for nailing or adhesively affixing materials to the structural wall.

OBJECTIVES OF THE INVENTION

In view of the obvious shortcomings of the various contemporary building methods, it is an objective of this invention to provide a building block which may be assembled by an unskilled laborer without the aid of mortar to create structures having plumb walls and square corners and insulative and structural integrity that is greater than masonry techniques but requires less man power to assemble than a woodframe structure.

A further objective of the present invention is to provide a method for fabricating a structure which includes assembling a number of blocks comprised of preformed skeletal subassemblies including end frames forming male and female coupling means on opposite ends of each subassembly.

A further objective of the present invention is to provide a method for fabricating a structure which includes assembling a number of blocks comprised of preformed hollow subassemblies including end frames forming male and female coupling means on opposite ends of each subassembly.

A still further objective of the present invention is to provide a building structure comprised of a plurality of interlocking blocks fabricated from formed metal strips.

A still further objective of the present invention is to provide a building structure comprised of a plurality of interlocking blocks fabricated from formed metal strips arranged to create hollow subassemblies joined in pairs to form construction block modules.

A still further objective of the present invention is to provide a building structure comprised of a plurality of interlocking blocks fabricated from cast or molded plastic material shaped to create hollow subassemblies joined to form construction blocks.

It is a further objective of the present invention to provide a building module fabricated from skeletal subassemblies that are shaped in the form of a block and incorporate end frames that will interlock the modules to permit fabricating a structure to meet the needs of the user.

Another objective of the present invention is to provide a method for building a structure comprised of assembling formed skeletal modules, inserting nailing strips in recesses provided therein, securing external and internal facing materials to the modules by nailing the facing materials to the nailing strips and filling the void between the internal and external facing panels with an insulating material.

Another objective of the present invention is to provide a method for building a structure comprised of assembling formed hollow modules, inserting nailing strips in recesses provided therein, securing external and internal facing materials to the modules by ailing the facing materials to the nailing strips and filling the void between the internal and external facing panels with an insulating material.

Another objective of the present invention is to provide a method for building a structure comprised of assembling formed skeletal modules, inserting nailing strips in recesses provided therein, securing external and internal facing materials to the modules by nailing the facing materials to the nailing strips and filling the void between the internal and external facing panels with an insulating material.

A still further objective of the present invention is to provide a method for building a structure comprised of assembling formed hollow modules, inserting nailing strips in recesses provided therein, securing facing materials to one side of the modules by nailing the facing materials to the nailing strips and spraying a masonry or resinous insulating and weatherproofing material over the exposed side of the hollow modules and back of the facing materials to complete a wall structure.

Another objective of the present invention is to provide a method for building a structure comprised of assembling formed skeletal modules and securing facing materials to the modules by an adhesive means applied to selected flat surfaces of the formed metal strips creating the modules.

Another objective of the present invention is to provide a method for building a structure comprised of assembling formed hollow modules and securing facing materials to the modules by an adhesive means applied to selected flat surfaces of the formed metal strips creating the modules.

Another objective of the present invention is to provide a method for building a structure comprised of assembling formed skeletal modules and securing facing materials to the modules by dry wall screws applied to selected flat surfaces of the formed metal strips creating the modules.

Another objective of the present invention is to provide a method for building a structure comprised of assembling formed hollow modules and securing facing materials to the modules by dry wall screws applied to selected flat surfaces of the formed metal strips creating the modules.

A still further objective of the present invention is to provide a building structure comprised of formed skeletal modules with facing materials secured by adhesive means to opposite sides of the modules and filling the void between facing panels with an insulating material.

A still further objective of the present invention is to provide a building structure comprised of formed hollow modules with facing materials secured by adhesive means to opposite sides of the modules and filling the void between facing panels with an insulating material.

The foregoing and other objectives of the invention will become apparent in light of the drawings, specification and claims contained herein.

SUMMARY OF THE INVENTION

Presented hereby is a building block or module which is fabricated by forming galvanized metal strips, plastic, fiberglass, or any other suitable materials to create a new form of building block structure having dimensions approximately equivalent to contemporary building blocks. The new building blocks include at least two subassemblies joined by interconnecting webs and may be skeletal or hollow.

In the embodiments using skeletal construction, each skeletal subassembly includes upper and lower frames joined together by a plurality of structural columns perpendicular to the planes of the upper and lower frames. The upper and lower frames are dimensioned to form interfitting male and female receptacles that permit the blocks to be interconnected. D-lance snap fit structures are provided in the upper and lower frames so that an assembly of blocks with structural integrity may be created by snapping together courses of blocks with each course staggered relative to the adjacent course. Recesses are formed in at least one side of each block between subassemblies. The recesses are along the midline and dimensioned to receive nailing strips to which a facing panel may be secured. The skeletal blocks are provided with D-lance snap fit means which lock the male frame ends into the female frame ends of adjacent blocks so that a structure may be fabricated by stacking the blocks in a conventional staggered manner similar to that used in masonry construction.

In the embodiments using hollow construction, the upper and lower frames and perpendicular columns are merged into one continuous rectangular tube that may include sealing top and bottom panels. Irrespective of whether or not top and bottom panels are used, snap fit lock means may be incorporated in the top and bottom end of the tubes in a manner similar to that described for the skeletal embodiments.

A structural wall formed from a plurality of the blocks is completed by inserting nailing strips in the provided recesses and nailing a facing material along one or both sides of the block wall. Alternatively, facing material may be secured directly to the flat surfaces of the strips or blocks. Insulating material may be inserted in the hollow spaces between the facing materials or if desired, facing material may be applied to only one side of the wall and the other completed by spraying a masonry product or other suitable material over the exposed skeletal structure or in the tubes and the back of the facing material to build up a thickness equivalent to the width of the blocks.

DESCRIPTION OF THE INVENTION

Figure 1:
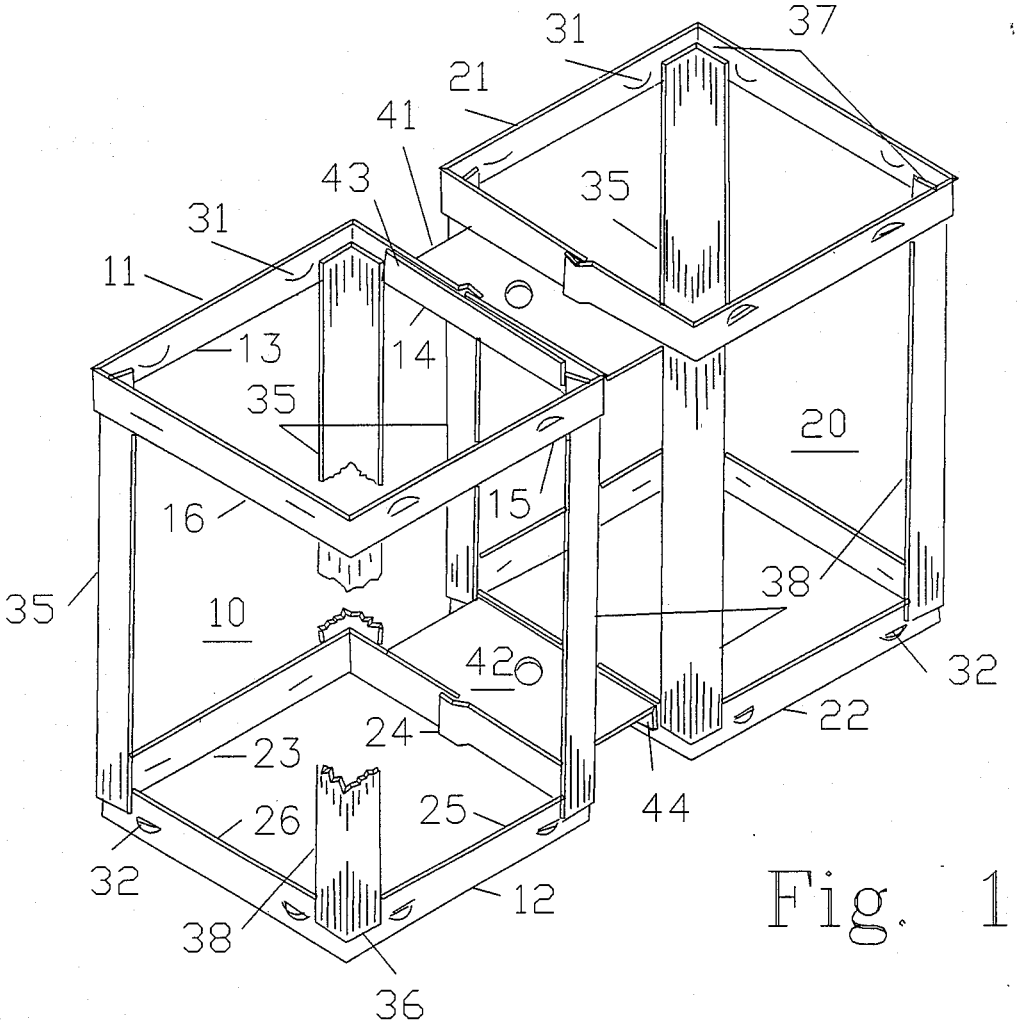
FIG. 1 is a ¾ view of a preferred embodiment of the building block of the present invention.

FIG. 1 illustrates the basic, skeletal building block embodiment upon which this invention is predicated and which is incorporated in the various methods of structure fabrication taught herein. The block is comprised of a framework fabricated from metal, plastic, reinforced plastic or any other material capable of being formed into the required basic strip shapes. In the preferred embodiment, 28 gauge galvanized steel sheet material is used. Preferably, the steel sheet is galvanized after the strips are cut, formed and assembled into skeletal blocks. Regardless of material used, its strength is calculated to meet the anticipated stress which will be encountered in the structure fabricated from a plurality of similar blocks. The use of galvanized metal strips of the preferred embodiment is presented as a convenient form in which to describe the invention. The strips can be fabricated from metal, plastic, fiberglass, boron filament, or a wide variety of materials having the required physical properties which will enable the creation of a strong and resilient structure.

The exemplary building block illustrated in FIG. 1 is comprised of two identical subassemblies identified as 0 and 20. Each subassembly is comprised of a top frame, 11 or 21 respectively. The top frames of the subassemblies are identical. They each form a square in the preferred embodiment but may be any geometric shape limited only by the requirement of having straight sides which match the sides of adjoining structures. They include latch means 31 formed in or affixed to the straps or wall members 13, 14, 15 and 16 forming the top frame structure. A spacer 41 connects top frames 11 and 21 together. In the illustrated embodiment, the spacer is fabricated from the same material as the top frames, that is, 8 gauge steel sheet material which is galvanized after the manufacturing assembly of the block.

Each subassembly includes a bottom frame, 12 or 22. The bottom frames are identical to the top frames except they are formed slightly smaller than the top frame so that a bottom frame will nest within a top frame in the manner of a male and female coupling. The bottom frames are provided with snap fit coupling elements 32 which cooperate with the snap fit coupling elements 31 when two blocks are nested together. The bottom frames comprised of side walls 23, 24, 25 and 26 are joined by a spacer 42 which, in the illustrated embodiment, is identical to spacer 41. In FIG. 1, spacer 41 includes flanges, 43, on either side which are secured to the inside of the top frame straps.

The spacer 42 joining the bottom frames is secured by flanges 44 to the outside of the lower frame straps to accommodate the differences in dimensions between the top and bottom frames. The top and bottom frames are joined by angle members 35 and 38 positioned at each corner to complete the basic block structure comprised of two similarly shaped subassemblies having top and bottom frames dimensioned so that blocks can be interconnected by the male and female joint functions created b their relative dimensional differences. The corner legs 35 and 38 are secured to the inside of the corners of the top frame and to the outside of the corners in the bottom frame to accommodate the differences in dimension between the top and bottom frames. When the frames are assembled, the bottom, 36 of each leg 35 or 38 rests on the top, 37 of the mated block structure so that a column of subassemblies, 10 and 10, result in a building structure comprised of four columns of angle members securely held relative to each other by top and bottom frames to effect a continuous vertical, load bearing structure.

Figure 3:
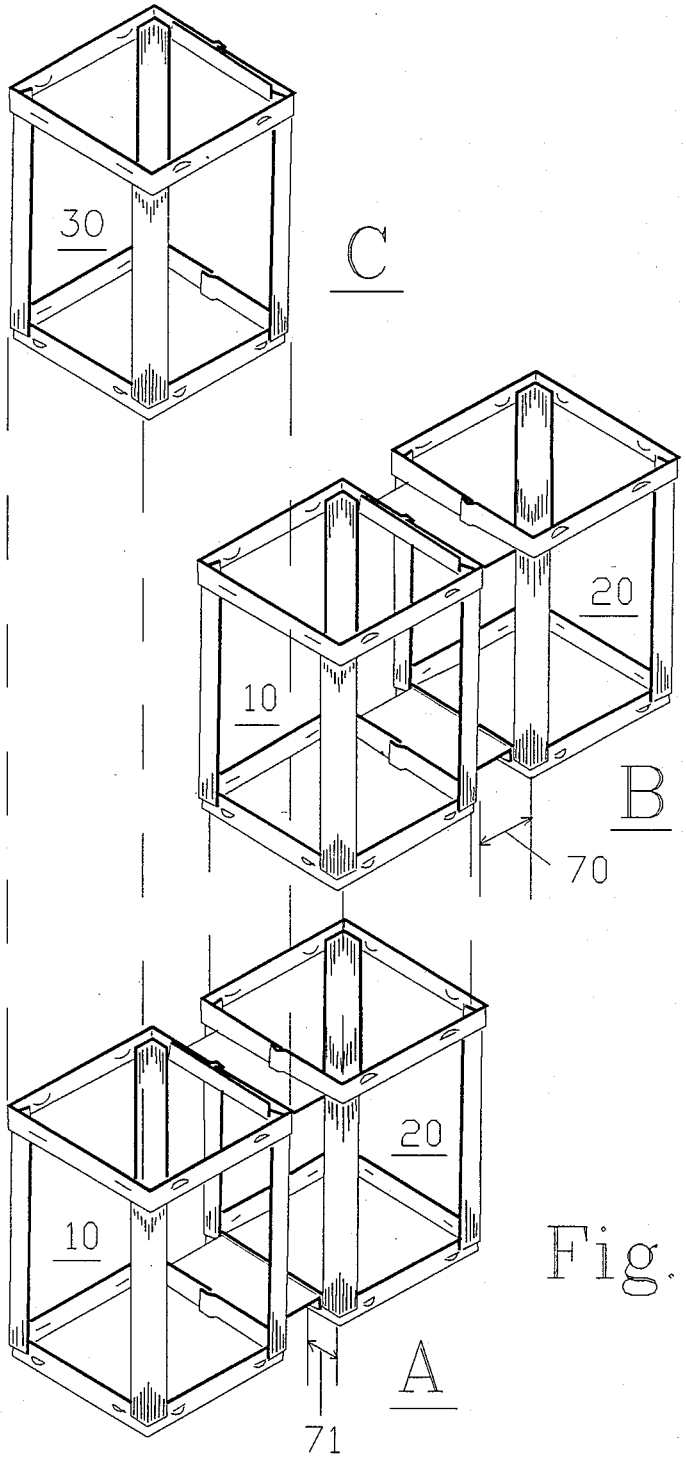
FIG. 3 illustrates the relationship of two bIock assemblies being brought together to form a straight wall section.

Nesting of two block assemblies to create a straight wall is illustrated in FIG. 3. Subassembly 10 of block "B" is inserted into subassembly 20 of block "A" to create a staggered interlock.

Single, unattached subassemblies are provided to square off wall ends, such as the single block 30 of FIG. 3. This block locks into the top of subassembly 10 of block A and if an overlying course is required, it will lock into the top of block 30 just as subassembly 10 of block B locks into subassembly 20 of block A.

Figure 2:
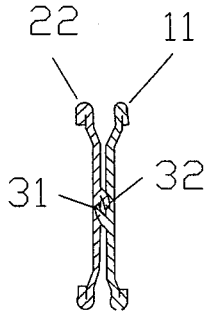
FIG. 2 is a cutaway view of a male and female frame end taken through the D-lance snap-fit structure.

FIG. 2 illustrates a cutaway section of a side strap of a top frame 11 and bottom frame 22 of a pair of nested subassemblies. A D-lance arrangement is illustrated to provide a snap fit for the two frames but other mechanical fasteners such as screws, nuts and bolts, rivets, glue or nails may be used. The D-lance is created by horizontal cuts through the strap material of 11 and 22 of FIGS. 1 and 2 and deformation of the metal adjacent to the slits creates an arcuate extension 31 or 32. In the embodiment illustrated in FIG. 2, the upper frame member, 11, is identical to the lower frame member except in size and the metal is deformed in the opposite side of the cut through the web to create the interlocking shape.

Figure 4:
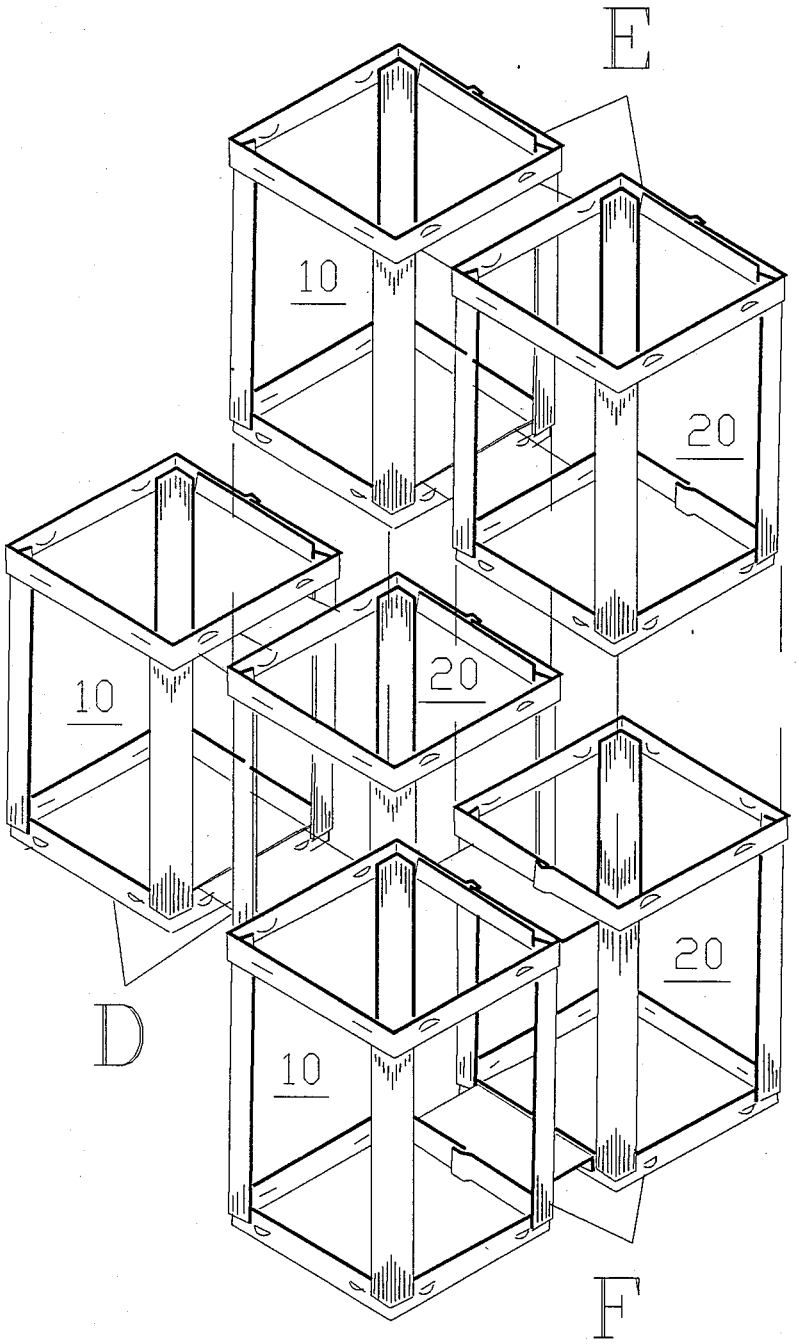
FIG. 4 is an exploded view of two block assemblies arranged to form a 90 degree corner.

FIG. 4 illustrates block assemblies arranged at right angles to form a corner. Blocks "F" and "D" are placed at 90 degrees to each other and interlocked by block "E" which is in the same plane as block "D" and 90 degrees to block "F". Note that subassembly 10 of block "E" fits into subassembly 20 of block "D" and subassembly 20 of block "E" fits into subassembly 20 of block "F".

Figure 5:
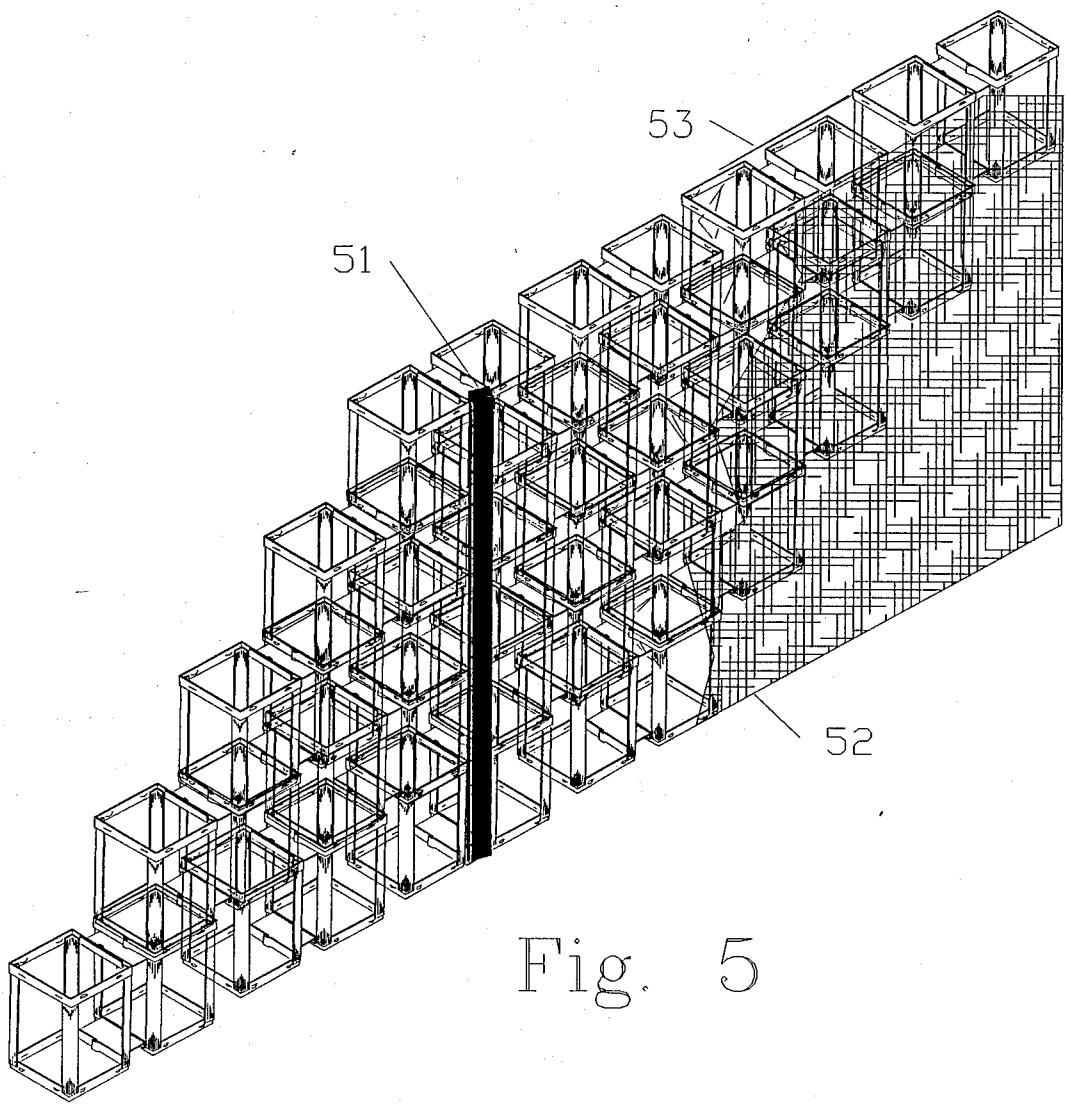
FIG. 5 is a cutaway view illustrating a basic structural wall present invention.

When a plurality of blocks are assembled with the top and bottom frames of the subassemblies nested or interconnected together as illustrated in FIGS. 3 or 4, a structural wall having significant load bearing properties is created. In a preferred embodiment, FIG. 5, the blocks are set so that the top frame receives the bottom frame of the next course of blocks in a staggered interlock arrangement as illustrated in FIG. 3. This results in a structure having vertical channels dimensioned as a function of spacing web members 41 and 42 which may be used to support floor joists or roof truss members. Studs, such as wood 1×2's or metal studs are set into the channels. In the fabrication of the basic blocks, the spacers are dimensioned so that the end product will match the type of stringer or stud that is to be used in the wall assembly. That is, the length of the spacer creates a space, 70, between vertical members of adjacent subassemblies 10 and 20 which equals the width of the studs to be used, see FIG. 3. The length of the spacer is controlled so the distance between its edges and block face, 71, equals the depth of the stud. FIG. 5 illustrates the use of metal studs 51 positioned in the channels formed by the web spacing between subassemblies of alternate courses and the spacing between blocks in the adjacent courses.

FIG. 5 is a cutaway view of a wall assembled from a plurality of blocks to illustrate the use of a metal or wood studs 51 which provide a nailing surface for wall sheathing 52 and 53 as well as structural integrity for the assembled wall. If desired, the wall sheathing may be secured directly to the blocks by adhesives or any of a number of mechanical fasteners such as nuts and bolts, rivets, screws, dry wall screws, spring clips etc.

When mechanical fastened devices such as screws are used to hold a wall sheathing to the basic skeletal structure, the snap fittings 31 and 32 may be eliminated in favor of securing the blocks together by the same mechanical device which secures the wall sheathing to the structure. If additional security is required, additional mechanical fasteners such as nuts and bolts, rivets, screws or clamps may be used in addition to those securing the sheathing to the structure.

The space between wall sheathing 52 and 53 of FIG. 5 may be filled with an insulating material or concrete. One or both sheathings may be removed after the filling material 55 sets, see FIG. 6. Alternately, only one side of the wall may be covered by sheathing and the filling material may be packed into the skeletal framework by any standard means such as hand packing or pneumatic blowing.

The bottom course of blocks in a wall may be set in a footer excavation or concrete form such that when the footer material, such as concrete, is poured, it will be reinforced by the blocks. In this type of structure, the top of the block course must extend above the concrete high enough to receive the bottoms of the next course of blocks as illustrated i FIG. 6 where the bottom courses 63 and 64 are set in footers 61 and 62.

Figure 6:
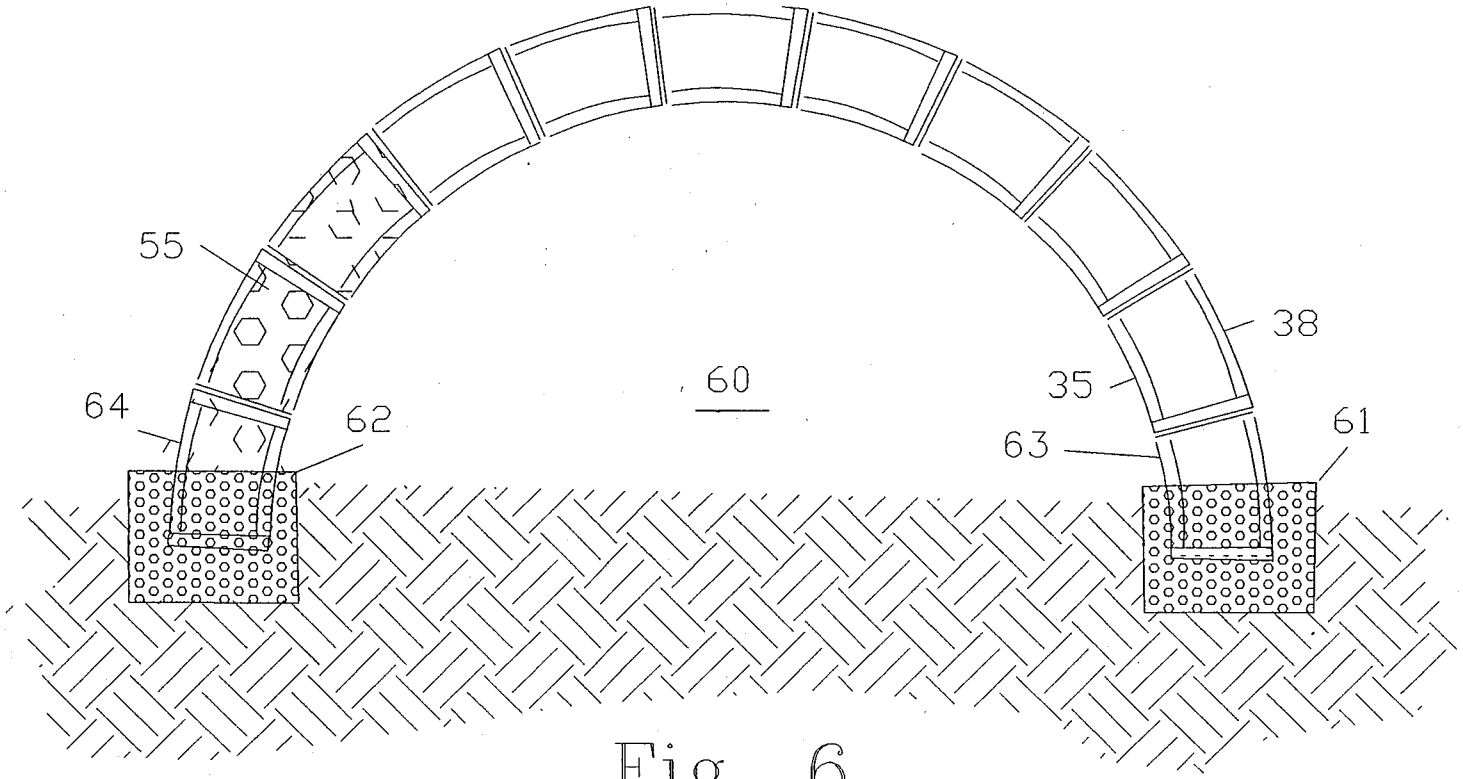
FIG. 6 is a cutaway view illustrating an arch fabricated from the structural blocks of the present invention.

The block structure illustrated in FIGS. 1 and 3 through 5 is fabricated using vertical support members 35 and 38 of equal dimensions. If required, the vertical members 35 may be different in length than vertical members 38. This results in a structure which may be used to create an arch. FIG. 6 illustrates such a structure where support members 35 are shorter than support members 38. A more esthetic and stronger structure may be created by curving support members 35 and 38 to conform with the overall dimensions of the desired arch 60.

In FIG. 6, the arch 60 is secured at both ends to footers 61 and 62 which, may be partially buried in the earth as required by local building codes.

Figure 7:
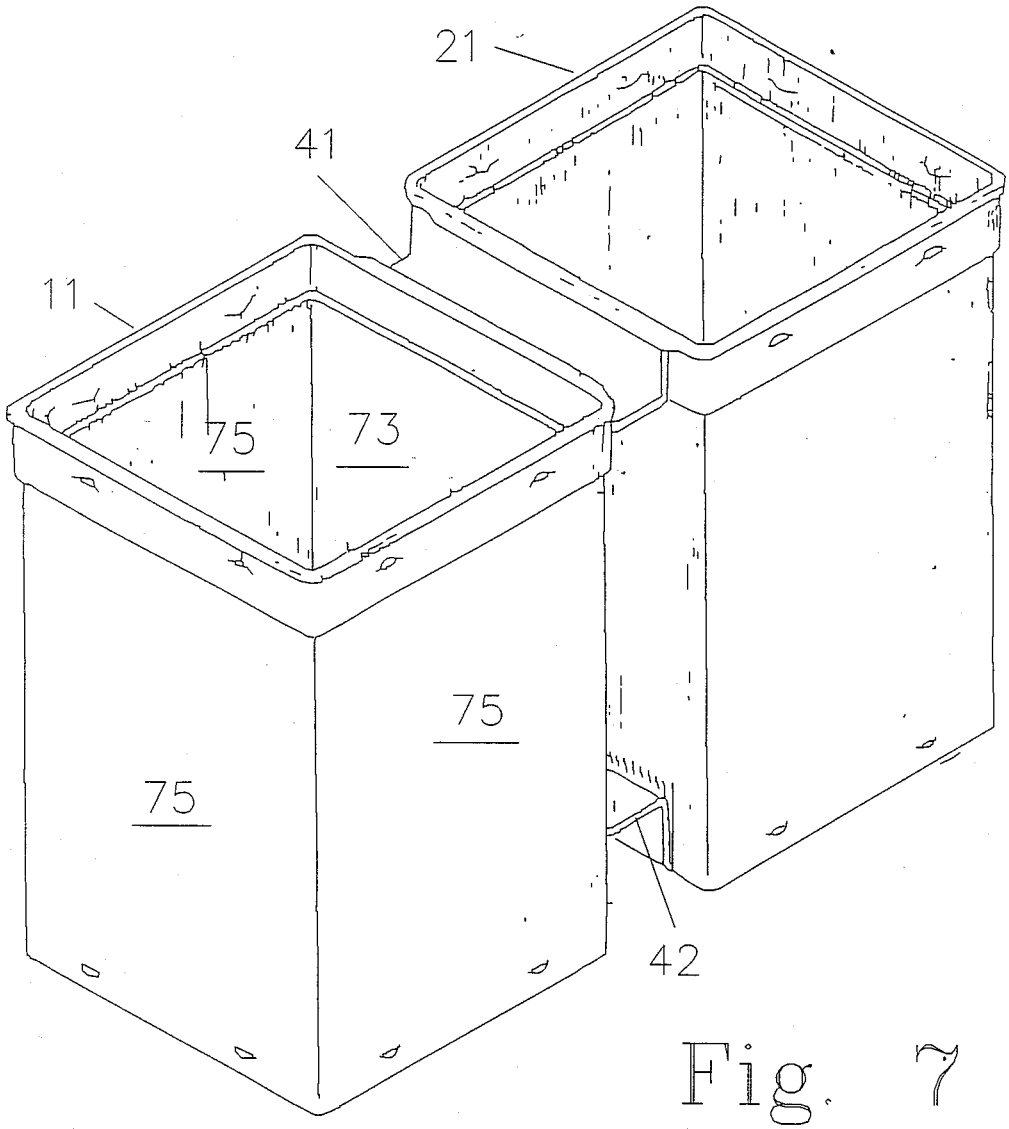
FIG. 7 is a ¾ view of an alternate embodiment of the building the present invention.

An alternate embodiment of the building blocks illustrated in FIGS. 1 through 6 is illustrated in FIG. 7 wherein the side walls which comprise the top and bottom frame of the skeletal embodiment are extended to join and create a tube, thereby eliminating the need for the corner, vertical support channels. In this embodiment, each subassembly tube may be fabricated from a bent metal sheet or cast or molded from a plastic or similar material. In the illustrated embodiment, a top frame 11 similar to the top frame of the skeletal embodiment is joined to the extended side walls 73, 74, 75 and 76 of the bottom frame. This could be reversed with the top frame side walls being extended to join the bottom frame side walls or, in a still further version of the tube embodiments, the top and bottom frames similar to those utilized in FIGS. 1 through 5 may be joined by walls which replaces the vertical channels of FIGS. 1 through 5 to join the top and bottom frames together to create a tubular structure. The subassemblies so created result in blocks with totally enclosed sides having open tops and bottoms to permit inserting reinforcing rods 77 and filling the tubes with concrete 78 to create solid pillars within a wall frame work.

Figure 8:
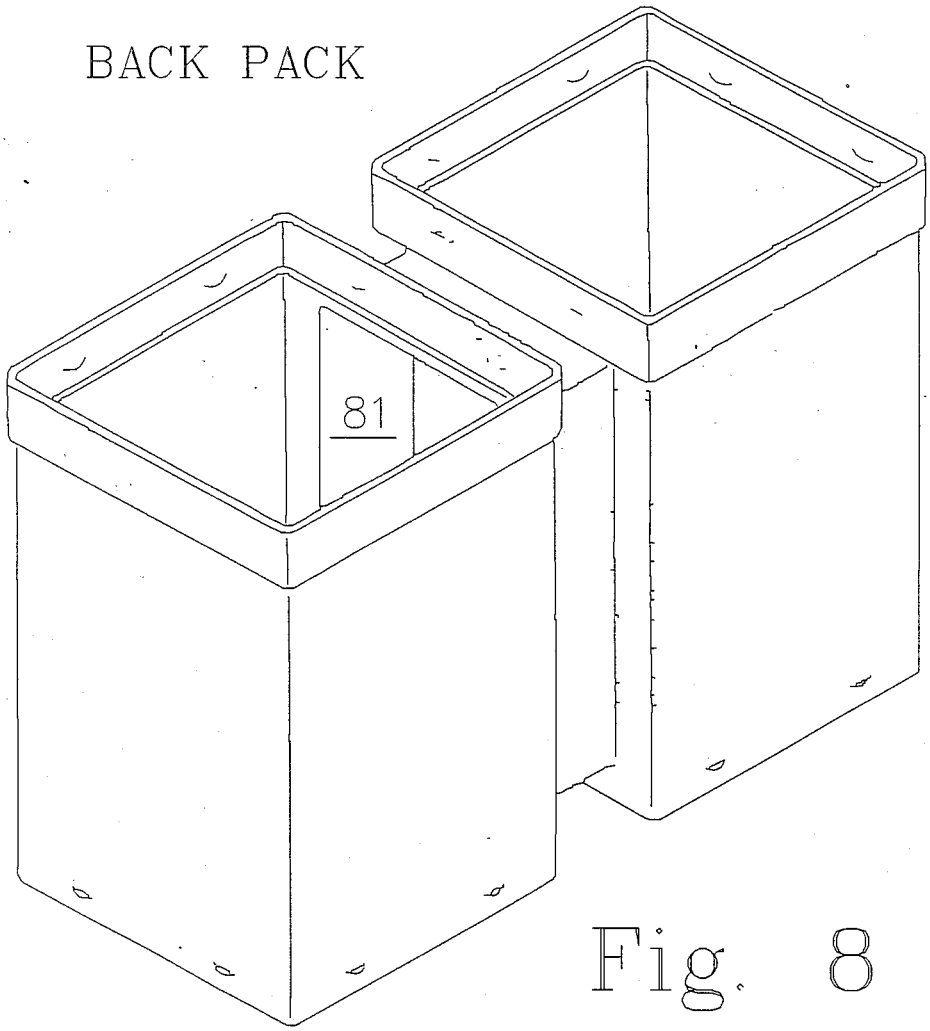
FIG. 8 is a modified form of the alternate embodiment illustrated in FIG. 7.

FIG. 8 illustrates another version of the alternate tubular embodiment illustrated in FIG. 7. In this version, the bottom of the tubular structure is closed to create a pair of containers. In the illustrated version, the joining webs 41 and 42 of FIGS. 1 and 7 are replaced by a conduit 81 which joins the two subassemblies together to create a continuous container that may be used to transport materials to a building site. After materials are removed for use at the site, the container is then used to build a structure. Thus this adaptation of the invention provides an ideal building block for military use or use in remote areas because a building block may be used as a back pack to allow individuals to carry materials to a building site and then the back pack, after it is no longer needed, is used to form part of a structure.

Figure 9:
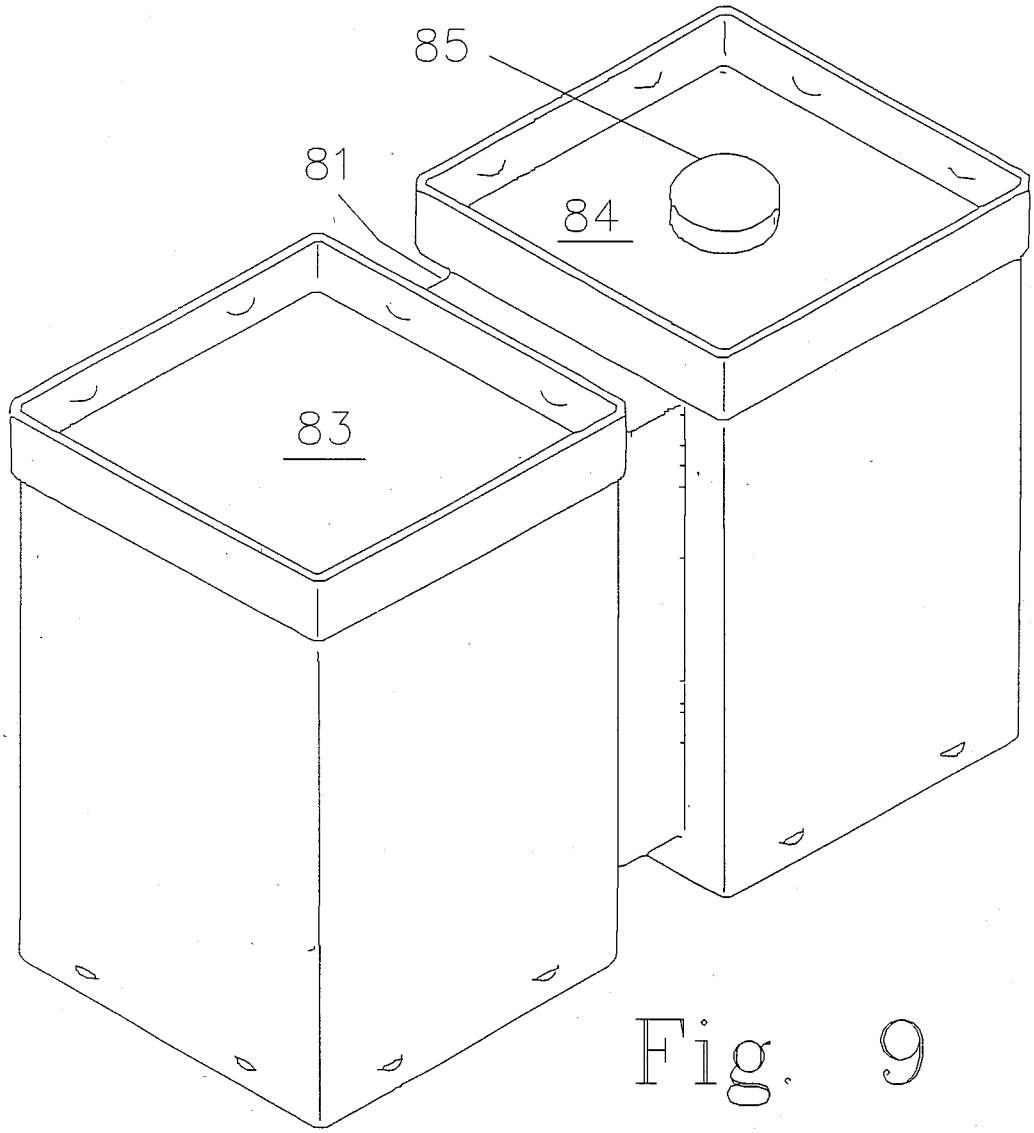
FIG. 9 is a modified form of the alternate embodiment illustrated in FIG. 8.
Figure 10:
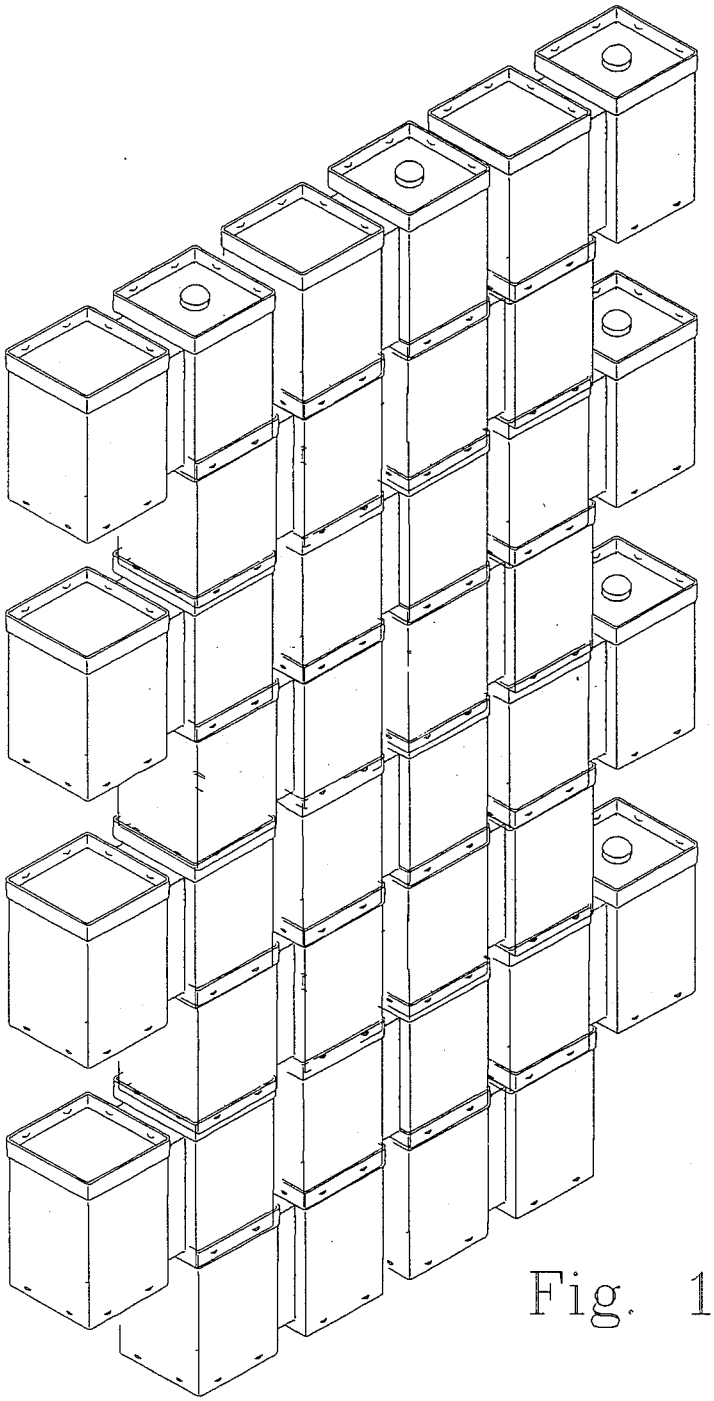
FIG. 10 a floating platform constructed from a form of the invention illustrated in FIG. 9.

FIG. 9 is a still further variation of the tubular embodiment of FIGS. 7 and 8. In this embodiment, a bottom closes the tubes as in FIG. 8 and top 83 and 84 are sealed within the top frames to create closed containers. A spout and cap 85 may be provided in one or both tops to permit adding and removing materials from the vessel. When this version of the invention is used, a plurality of containers may be joined together to create a raft or similar floating structure. For instance, if a group of closed containers similar to those illustrated in FIG. 9 are assembled as illustrated in FIG. 3, the resultant item may be used as a wall or as a raft or floating dock such as illustrated in FIG. 10.

While preferred embodiments of this invention have been illustrated and described, variations and modifications may be apparent to those skilled in the art. Therefore, I do not wish to be limited thereto and ask that the scope and breadth of this invention be determined from the claims which follow rather than the above description.

What I claim is:

1. A construction block, comprising:

first and second identical subassemblies joined together;

each of said subassemblies comprising, a top frame including side walls forming a closed geometric shape, one of said top frame wall members connected via said spacing means to a side wall member of the top frame of the other said subassembly to form the top of said construction block;

a bottom frame including side wall members, one of said bottom frame side wall members connected via said spacing means to a side wall member of the bottom frame of the other said subassembly to form the bottom of said construction block;

a plurality of support member secured between said top frame and said bottom frame, said support members dimensioned to cause said top frame and said bottom frame to lie in superposed and parallel orientation with respect to each other;

said top and bottom frames shaped geometrically identical but sized so said top and bottom frames of similar construction blocks will interfit in the manner of a male and female coupling; and said top and bottom frames include deformable means for engaging mating deformable means when said top and bottom frames of like construction blocks are interfit, said deformable means adapted to interlock said construction blocks.

2. A construction block as defined in claim 1 wherein a plurality of said top and bottom frame side walls include connection means extending from said frame side walls for interlocking said construction block to another block, said connection means dimensioned to fit within said connection means in the frame side wall of another block when said construction block and the other block are superimposed.

3. A construction block as defined in claim 1 wherein said plurality of support members are equal in length.

4. A construction block as defined in claim 1 wherein said support members on one side of said construction block are equal in length but not of the same length as said support members on the other side of said construction block.

5. A construction block as defined in claim 1 wherein said plurality of support members are interconnected between said top and bottom frames at the frame corners.

6. A construction block as defined in claim 1 wherein said top and bottom frames each include four of said side wall members.

7. A construction block, comprising:

first and second identical subassemblies joined together; and each of said subassemblies comprises: (A) a top frame including wall members, one of which connects said top frame via said spacing means to the top frame of the other said subassembly to form the top of said construction block, (B) a bottom frame including wall members, one of which connects said bottom frame via said spacing means to the bottom frame of the other said subassembly to form the bottom of said construction block, (C) a plurality of support members secured between said top frame and said bottom frame, (D) said top and bottom frames are shaped geometrically identical but sized so said top and bottom frames of similar construction blocks will interfit in the manner of a male and female coupling, and (E) said support members are curved such that said construction block assumes a curved shape with said top offset from said bottom.

8. A construction block as defined in claim 7 wherein said top frame is rectangular in shape.

9. A construction bloc, comprising:

first and second identical subassemblies joined together;

each of said subassemblies including, a top and a bottom frame secured together by a plurality of support members;

said top and bottom frames are shaped identically but dimensioned to interfit in the manner of a male and female coupling; and said top and bottom frames include deformable means for engaging mating deformable means when said top and bottom frames of like construction blocks are interfit, said deformable means adapted to interlock said construction blocks.

10. A wall, comprising, a plurality of courses of construction blocks interconnected to form a series of blocks creating an integral unit, said construction block comprising:

first and second identical subassemblies joined together;

each of said subassemblies including, a top and a bottom frame secured together by a plurality of support members;

said top and bottom frames are shaped identically but dimensioned to interfit in the manner of a male and female coupling; and said top and bottom frames include deformable means for engaging mating deformable means when said top and bottom frames of like construction blocks are interfit, said deformable means adapted to interlock said construction blocks.

11. A wall as defined in claim 10, comprising:

a facing panel means secured to one side of said construction blocks.

12. A wall as defined in claim 11, further comprising:

a second facing panel means secured to the side of said construction blocks opposite said facing panel means.

13. A wall as defined in claim 12, further comprising insulating material positioned between said facing panel means and said second facing panel means.

14. A wall as defined in claim 11, further comprising a coating sprayed through said construction blocks onto the construction block side of said facing panel to a thickness covering said construction blocks.

15. A method for forming a wall, including the steps of:

preparing a footer excavation;

laying down a first course of construction blocks which include a plurality of top interfitting frames in said footer excavation;

poring concrete in said footer excavation to a depth which does not cover the top frame of said construction blocks;

securing a course of skeletal construction blocks which include a plurality of top and bottom interfitting frames on said course of construction blocks set in said concrete footer;

building additional courses of similar construction blocks on said first course by positioning individual construction blocks in an overlapping fashion, over adjoining construction blocks in a lower course and interlocking said construction blocks by said interfitting top and bottom frames in the manner of a coupling.

16. A method for forming a wall as defined in claim 15, including the further steps of:

securing a facing panel to said assembly of construction blocks.

17. A method of fabricating a wall as defined in claim 15, including the steps of:

inserting structural strips in channels created by said spacing means; and securing facing material to said strips.

18. A method for building a wall as defined in claim 15, including the steps of:

attaching facing material to one side of said assemblage of construction blocks; and coating the side of said facing material attached to said construction blocks with a hardenable material to a thickness great enough to cover said construction blocks.

19. A construction block, comprising:

first and second identical subassemblies joined together by spacing means;

each of said subassemblies comprising a tube with a top frame and a bottom frame, said top frame connected via said spacing means to the top frame of the other said subassembly to form the top of said construction block, and said bottom frame connected via said spacing means to the bottom frame of the other said subassembly to form the bottom of said construction block;

a plurality of wall member connecting said top frame and said bottom frame, said wall members dimensioned to cause said top frame and said bottom frame to lie in superposed and parallel orientation with respect to each other;

said top and bottom frames shaped geometrically identical but sized so said top and bottom frames of similar construction blocks will interfit in the manner of a male and female coupling; and said top and bottom frames include deformable means for engaging mating deformable means when said top and bottom frames of like construction blocks are interfit, said deformable means adapted to interlock said construction blocks.

20. A construction block, comprising:

first and second identical subassemblies joined together;

each of said subassemblies comprising a tube with a top frame and a bottom frame, said top frame connected to the top frame of the other said subassembly to form the top of said construction block, and said bottom frame connected to the bottom frame of the other said subassembly to form the bottom of said construction block;

a plurality of wall members connecting said to frame and said bottom frame, said wall members dimensioned to cause said top frame and said bottom frame to lie in superposed and parallel orientation with respect to each other;

said top and bottom frames shaped geometrically identical but sized so said top and bottom frames of similar construction blocks will interfit in the manner of a male and female coupling; and said top and bottom frames include a plurality of connection means extending from said frames for interlocking said construction block to another block, said connection means dimensioned to fit within said connection means in the frame of another block when said construction block and the other said block are superimposed.

21. A construction block as defined in claim 19 wherein said wall members are equal in length.

22. A construction block as defined in claim 19 wherein said wall members on one side of said construction block are equal in length but not of the same length as said wall members on the other side of said construction block.

23. A construction block as defined in claim 19 wherein one of said frames of a subassembly tube and said wall members of said subassembly tube are formed from a continuous piece of material.

24. A construction block as defined in claim 19 wherein said top and bottom frames and said wall members are formed from a continuous piece of material.

25. A construction block as defined in claim 19, including bottoms for said tubes.

26. A construction block as defined in claim 25, including tops for said tubes.

27. A construction block as defined in claim 26, including a conduit between said tubes.

28. A construction block as defined in claim 26, comprising:

an opening; and a means for closing said opening.

29. A construction block, comprising:

first and second identical subassemblies joined together by spacing means;

each of said identical subassemblies comprising, a top frame including wall members, one of which connects said top frame via said spacing means to the top frame of the other said subassembly to form the top of said construction block, a bottom frame including wall members, one of which connects said bottom frame via said spacing means to the bottom frame of the other said subassembly to form the bottom of said construction block, and wall members forming continuous sides between said top frame and said bottom frame; and said top and bottom frames include deformable means for engaging mating deformable means when said top and bottom frames of like construction blocks are interfit, said deformable means adapted to interlock said construction blocks.

30. A construction block as defined in claim 29 wherein said top frame is rectangular in shape.

31. A construction block, comprising:

first and second identical subassemblies joined together;

each of said subassemblies including, a top and a bottom frame joined together by a plurality of wall members dimensioned to form the sides of a closed sided structure;

said top and bottom frames are shaped identically but dimensioned to interfit in the manner of a male and female coupling; and said top and bottom frames include deformable means for engaging mating deformable means when said top and bottom frames of like construction blocks are interfit, said deformable means adapted to interlock said construction blocks.

32. A plurality of courses of construction blocks interconnected to form a series of blocks creating an integral unit wherein each of said construction block comprises:

first and second identical subassemblies joined together;

each of said subassemblies including, a top and a bottom frame joined by wall members forming subassembly tubes;

said top and bottom frames are shaped identically but dimensioned to interfit in the manner of a male and female coupling; and reinforcing rod and concrete positions within said subassembly tubes.

33. A wall as defined in claim 32, comprising:

a facing panel means secured to one side of said construction blocks.

34. A wall as defined in claim 33, further comprising:

a second facing panel means secured to the side of said construction blocks opposite said facing panel means.

35. A wall as defined in claim 32, further comprising insulating material positioned within said subassembly tubes.

36. A method for forming a wall, including the steps of:

preparing a footer excavation;

laying a course of building blocks in said footer excavation;

pouring concrete in said footer excavation to a depth which does not cover the top frame of said construction blocks;

laying down a second course of construction blocks which include a plurality of top and bottom interfitting frames;

building additional courses of similar construction blocks on said second course by positioning individual construction blocks in an overlapping fashion over adjoining construction blocks in a lower course and interlocking said construction blocks by said interfitting top and bottom frames in the manner of a male/female coupling; and pouring concrete to fill the voids created by the alignment of said interfitting frames.

37. A method for forming a wall as defined in claim 36, including the further steps of:

securing a facing panel to said assembly of construction blocks.

38. A method of fabricating a wall as defined in claim 36, including the steps of:

inserting structural strips in channels created by said spacing means; and securing facing material to said strips.

* * * * *